US011505910B2

(12) United States Patent
Bush et al.

(10) Patent No.: US 11,505,910 B2
(45) Date of Patent: Nov. 22, 2022

(54) SEGMENTAL RETAINING WALL UNIT

(71) Applicant: KCJ BLOCK, LLC, Georgetown, TX (US)

(72) Inventors: Brian H. Bush, Temple, TX (US); Wyndon Kyle Nix, Belton, TX (US)

(73) Assignee: KCJ BLOCK, LLC, Georgetown, TX (US)

( * ) Notice: Subject to any disclaimer, the term of this patent is extended or adjusted under 35 U.S.C. 154(b) by 0 days.

(21) Appl. No.: 17/489,115

(22) Filed: Sep. 29, 2021

(65) Prior Publication Data

US 2022/0098816 A1 Mar. 31, 2022

Related U.S. Application Data

(60) Provisional application No. 63/084,879, filed on Sep. 29, 2020.

(51) Int. Cl.
*E02D 29/02* (2006.01)

(52) U.S. Cl.
CPC ..... *E02D 29/0266* (2013.01); *E02D 29/025* (2013.01)

(58) Field of Classification Search
CPC ..... E02D 29/0266; E02D 29/025; E02D 2600/20; E04B 2002/0204; E04B 2/32
See application file for complete search history.

(56) References Cited

U.S. PATENT DOCUMENTS 250,635 A * 12/1881 McLean ..... E04C 1/42 405/114
2,482,556 A 9/1949 Petras
5,064,313 A 11/1991 Risi et al.
5,252,017 A 10/1993 Hodel
5,257,880 A 11/1993 Janopaul, Jr.
5,282,700 A * 2/1994 Rodrigue ..... E02D 29/025 405/286
D346,667 S 5/1994 Blomquist et al.
D363,787 S 10/1995 Powell
5,528,873 A * 6/1996 Correia ..... E04B 2/06 405/286
D384,168 S 9/1997 Stevenson
(Continued)

OTHER PUBLICATIONS

ReCon Wall Systems, Inc., "Design and Construction Manual: An in Depth Guide for Specifiers, Engineers and Installers", 5th Revision, Apr. 2017.

*Primary Examiner* — Carib A Oquendo
(74) *Attorney, Agent, or Firm* — Wenderoth, Lind & Ponack, L.L.P.

(57) ABSTRACT

A retaining wall block kit includes a block and an adjustable setback bar having a break line extending along a widthwise centerline between the front surface and the rear surface. The block has alignment knuckles protruding downwardly from a bottom surface of a front section, and has a receiver channel extending laterally across a top surface of the front section for receiving the alignment knuckles of an adjacent upper block. The setback bar can be removably located within the receiver channel, and is configured to be split along the break line. Thus, the setback bar is adjustable by being modified or omitted altogether to change the distance between the alignment knuckles and a front surface of the receiver channel and thereby allow the setback of the retaining wall to be changed as desired.

18 Claims, 3 Drawing Sheets

(56) References Cited

U.S. PATENT DOCUMENTS

| | | | |
|---|---|---|---|
| D397,451 | S | 8/1998 | Stevenson |
| 5,816,749 | A | 10/1998 | Bailey, II |
| 5,941,042 | A | 8/1999 | Dueck |
| 5,951,210 | A | 9/1999 | Maguire et al. |
| 6,138,426 | A | 10/2000 | Mork et al. |
| 6,168,354 | B1 | 1/2001 | Martin et al. |
| D439,678 | S | 3/2001 | Blomquist et al. |
| D445,512 | S | 7/2001 | Sievert |
| D459,487 | S | 6/2002 | Bott |
| 6,474,036 | B2 | 11/2002 | Martin et al. |
| D467,009 | S | 12/2002 | Agee |
| 6,615,561 | B2 | 9/2003 | MacDonald et al. |
| 6,709,201 | B2 | 3/2004 | Race |
| 6,827,527 | B2 | 12/2004 | Conkel et al. |
| 6,921,231 | B2 | 7/2005 | Rainey et al. |
| D509,911 | S | 9/2005 | Shillingburg |
| 7,059,808 | B2 | 6/2006 | Risi |
| D539,436 | S | 3/2007 | Magliocco et al. |
| 7,360,970 | B2 | 4/2008 | Woolford et al. |
| D587,382 | S | 2/2009 | Wauhop |
| 7,503,730 | B2 | 3/2009 | Price |
| 7,591,447 | B2 | 9/2009 | Hammer et al. |
| 7,731,455 | B2 | 6/2010 | Shin |
| 7,963,727 | B1 | 6/2011 | Wauhop |
| 7,971,407 | B2 | 7/2011 | MacDonald |
| D645,165 | S | 9/2011 | Wolter et al. |
| D645,575 | S | 9/2011 | Bone |
| D663,858 | S | 7/2012 | MacDonald |
| 8,371,086 | B1 | 2/2013 | Shillingburg |
| D689,203 | S | 9/2013 | MacDonald |
| 8,734,060 | B1 | 5/2014 | Wauhop |
| D708,765 | S | 7/2014 | MacDonald |
| D713,057 | S | 9/2014 | Mugge et al. |
| 8,851,803 | B2 | 10/2014 | Bott |
| 9,028,175 | B2 | 5/2015 | Friederichs et al. |
| 9,273,444 | B2 | 3/2016 | Walling |
| D867,620 | S | 11/2019 | Pegg |
| 2002/0028114 | A1 | 3/2002 | Whitson |
| 2004/0022587 | A1* | 2/2004 | Conkel ..... E02D 29/0225 405/284 |
| 2004/0159065 | A1* | 8/2004 | Burgess ..... E02D 29/025 52/574 |
| 2005/0091940 | A1 | 5/2005 | Whitson |
| 2006/0171784 | A1 | 8/2006 | Shaw |
| 2008/0244995 | A1 | 10/2008 | Kemp |
| 2009/0116911 | A1 | 5/2009 | Shaw |
| 2012/0057939 | A1 | 3/2012 | Bone |
| 2012/0279163 | A1 | 11/2012 | MacDonald et al. |
| 2012/0311943 | A1* | 12/2012 | Gran ..... E04G 21/147 52/588.1 |
| 2019/0368152 | A1 | 12/2019 | Rainey |
| 2020/0230849 | A1 | 7/2020 | Karau |
| 2021/0108390 | A1* | 4/2021 | Matys ..... E02D 29/0266 |

* cited by examiner

SEGMENTAL RETAINING WALL UNIT

BACKGROUND OF THE INVENTION

The present invention generally relates to the field of retaining walls and, more specifically, to retaining wall blocks and techniques for assembling a retaining wall unit of retaining wall blocks.

Retaining walls are widely used in a variety of landscaping applications. Typically, they are used for functional reasons to maximize or create level areas and/or to reduce erosion. They may also be used for purely decorative reasons. In the past, retaining wall construction was labor intensive and often required the skills of trained tradespeople such as masons and carpenters. More recently, retaining wall construction has become significantly simplified with the introduction of self-aligning, modular, molded blocks of concrete that may be stacked without the use of mortar or extensive training. With these types of retaining wall blocks, it is possible to erect a retaining wall quickly and economically, and the finished product creates the impression and appearance of a conventional block-and-mortar retaining wall.

The interconnection between adjacent levels (courses) of retaining blocks allows the retaining wall units to be easily, precisely, and reliably assembled. Typically, each retaining wall block will include a projection and a recess located at oppositely facing surfaces, such as a top surface and a bottom surface. The projection and recess are complementarily shaped, with the projection protruding beyond the top (or bottom) surface of the retaining block with the recess extending inwardly from the bottom (or top) surface of the block. In use, a projection of a first block is received within the recess of a second block to interconnect and position the blocks adjacent each other in a predetermined relation. With a plurality of retaining blocks, such interconnections make it possible to lay courses of blocks accurate and quickly. Moreover, such an assembled retaining wall will be able to resist some lateral forces exerted by the material being retained and reduce bowing. Blocks having these interconnections are generally the same size and may be assembled in a coplanar arrangement in only a simple, running bond pattern.

To further withstand the lateral forces exerted by the material being retained and thereby resist bowing or overturning, it is known to batter the retaining wall. In particular, the projection and recess of the retaining blocks may be arranged so that adjacent courses are offset a predetermined amount. With this type of retaining wall block, each successive course may be offset from the preceding course by the same amount so that the assembled wall is skewed at a predetermined angle from the vertical.

Depending on the height of the retaining wall, it may be desirable to adjust the amount of batter so as to avoid losing an excessive amount of land due to the setback of the wall. To adjust the setback, it has heretofore been necessary with conventional retaining wall systems to use a variety of block styles with differently shaped or located protrusions to change the batter of the wall. However, these retaining wall systems require numerous block types which increase the manufacturing costs of the retaining wall blocks and reduce the design flexibility. Other conventional retaining wall systems insert a spacer behind a protrusion extending from a top surface of the retaining blocks during assembly to increase the setback or batter of the retaining wall. However, this type of system only allows for one possible alternative setback amount, and makes construction of the retaining wall difficult due to the placement of the spacer.

SUMMARY OF THE INVENTION

The present invention has been developed in order to address the above-noted drawbacks. In particular, the invention is directed to a retaining wall block system (kit) and a method of assembling a retaining wall using such a retaining wall block system (kit).

In a first aspect, the invention is directed to a retaining wall block kit including a block having a front section, a rear section spaced apart from the front section, and a pair of laterally spaced apart side sections connecting the front section and the rear section to define a through-cavity extending through the block from a top face thereof to a bottom face thereof. The retaining wall block kit further includes an adjustable setback bar having a break line extending in a longitudinal direction of the setback bar between sides of the setback bar, and located along a widthwise centerline between the front surface and the rear surface.

The front section of the block has alignment knuckles protruding downwardly from a bottom surface of the front section at a location forward (in front of) of the through-cavity, and the alignment knuckles are laterally and evenly spaced apart from one another. The block has a receiver channel extending laterally across the top surface of the front section at a location forward of the through-cavity. The receiver channel is located and configured relative to the alignment knuckles so that two blocks can be stacked one atop the other with at least one of the alignment knuckles of the upper block engaged within the receiver channel of the lower block.

Depending on the desired setback (batter) of the retaining wall, the setback bar can be removably located within the receiver channel of the lower block so that the front surface of the setback bar abuts against a front surface of the receiver channel. The upper block is then position so that the alignment knuckles of the upper block abut against the rear surface of the setback bar within the receiver channel. The setback bar is also configured to be split along the break line, if desired. In particular, the setback bar can be 1" in width when whole, and ½" in width when split along the break line. When the setback bar is split and located within the receiver channel, the alignment knuckles of the upper block abut against the adjusted rear surface of the setback bar, which is an exposed surface of the split setback bar formed along the break line when the setback bar is split. Thus, the setback bar is adjustable or omitted altogether to change the distance between the alignment knuckles and a front surface of the receiver channel, and thereby allow the setback of the retaining wall to be easily changed as desired for the particular retaining wall application. Consequently, there is no need for a variety of different types of blocks to adjust the setback (batter) of the retaining wall, and the blocks can be stacked quickly and easily.

In one embodiment, there are three alignment knuckles protruding downwardly from the bottom surface of the front section and aligned and spaced apart along a straight line on the bottom surface. Furthermore, a rear side of the receiver channel can be open to the through-cavity. In other words, the receiver channel can have a front surface and bottom surface with the rear side being open to the through-cavity to allow easier stacking of blocks.

The front section of the block can have a densification groove around a base of each of the alignment knuckles. The densification groove is a compressed (compacted) area forming a recess surrounding each of the alignment knuckles, and this compressed area of the front section of the block is more dense than other areas of the block which are not formed as densification grooves. This densification groove improves the strength of each alignment knuckle, thereby minimizing the chance of accidental breakage or chipping of the alignment knuckles.

Each of the alignment knuckles has an oval shape including a straight front side and a straight rear side parallel to the straight front side. The front side and rear side of each of the alignment knuckles are also parallel to the rear surface of the front section forming a surface of the through-cavity, and are also parallel to the front surface of the receiver channel. Thus, the alignment knuckles can lay flat against the front surface of the receiver channel or flat against the rear surface of the setback bar.

The break line of the setback bar can be any linearly-arranged perforations, holes, groove, notches or the like that are formed along the widthwise centerline located between the front surface and the rear surface of the setback bar, and which allow the setback bar to be snapped (split) along the widthwise centerline, preferably by hand. In particular, the break line can be a groove having a depth extending in a heightwise direction through the setback bar and extending all or most of the length of the setback bar to allow the setback bar to be split by hand. Such a groove forms a smooth adjusted rear surface against which the one or more alignment knuckles of the upper block can abut. By omitting the setback bar entirely from the receiver channel before placing the upper block, the setback (batter) of the retaining wall will be ⅛". However, by first splitting the setback bar along the break line (for example, to produce an adjusted setback bar having a width of ½") and then inserting the front half of the setback bar into the receiver channel, the setback (batter) of the retaining wall will be ⅝". If the setback bar is not split and instead is placed in the receiver channel as a whole (for example, having a width of 1"), the resulting setback (batter) of the retaining wall will be 1⅛".

The front section of the block can have three non-planar front surface sections (a tri-plane), or can have one planar front surface. In addition, the front surface can have a left and/or right score which aids in alignment of the blocks.

The invention is also directed to a method of assembling a retaining wall using multiple retaining wall block kits. Each retaining wall block kit is configured as described above including a block and a setback bar. The method includes first choosing one of a first setback (batter), a second setback (batter), and a third setback (batter) for the retaining wall based on design criteria for the retaining wall. The first setback is smaller than the second setback, and the second setback is smaller than the third setback. For example, the first setback can be ⅛", the second setback can be ⅝", and the third setback can be 1⅛". After choosing the desired setback, the setback bar is omitted, adjusted and arranged within the receiver channel, or simply arranged within the receiver channel without adjustment to achieve the desired setback.

In particular, if the first (smallest) setback is chosen, the setback bar is omitted from (i.e., not inserted within) the receiver channel of the block of the first retaining wall block kit. If the second (middle or medium-sized) setback is chosen, the setback bar is split along the break line and placed within the receiver channel. If the third (largest) setback is chosen, the setback bar is placed within the receiver channel without adjustment or modification such that the front surface of the setback bar abuts against the front surface of the receiver channel.

A block of one retaining wall block kit is then stacked atop a (lower) block of another retaining wall block kit so that one or more of the alignment knuckles of the (upper) block engage within the receiver channel of the lower block. The stacking is performed so that the one or more of the alignment knuckles of the upper block abuts against either (i) the front surface of the receiver channel if the first (smallest) setback is chosen, (ii) the adjusted (newly formed) rear surface of the setback bar if the second setback is chosen and the setback bar is split, or (iii) the rear surface of the unmodified setback bar if the third (largest) setback is chosen. Thus, the setback bar is adjustable (modified or omitted altogether) to allow the setback of the retaining wall to be easily changed as desired for the particular retaining wall application without the need for using different types and sizes of blocks, and while also allowing quick and easy assembly.

As noted above, there can be three alignment knuckles aligned along a straight line on the bottom face of each block. However, during assembly of the retaining wall, the inner one of the three alignment knuckles of the (upper) block of the second retaining wall block kit can be removed prior to stacking the (upper) block of the second retaining wall block kit atop the (lower) block of the first retaining wall block kit to form a retaining wall with a concave radius. Alternatively, the outer two of the three alignment knuckles of the (upper) block of the second retaining wall block kit can be removed prior to stacking the (upper) block of the second retaining wall block kit atop the (lower) block of the first retaining wall block kit to form a retaining wall with a convex radius.

The through-cavity of the block of each of the first and second retaining wall block kit can also be filled with crushed aggregate to provide additional interlock and mass to the retaining wall. In addition, geogrid can be applied between the (lower) block of the first retaining wall block kit and the (upper) block of the second retaining wall block kit to improve stability of the retaining wall.

BRIEF DESCRIPTION OF THE DRAWINGS

A detailed description of the present invention will be provided below with reference to the drawings, in which.

DETAILED DESCRIPTION OF THE INVENTION

Figure 1:
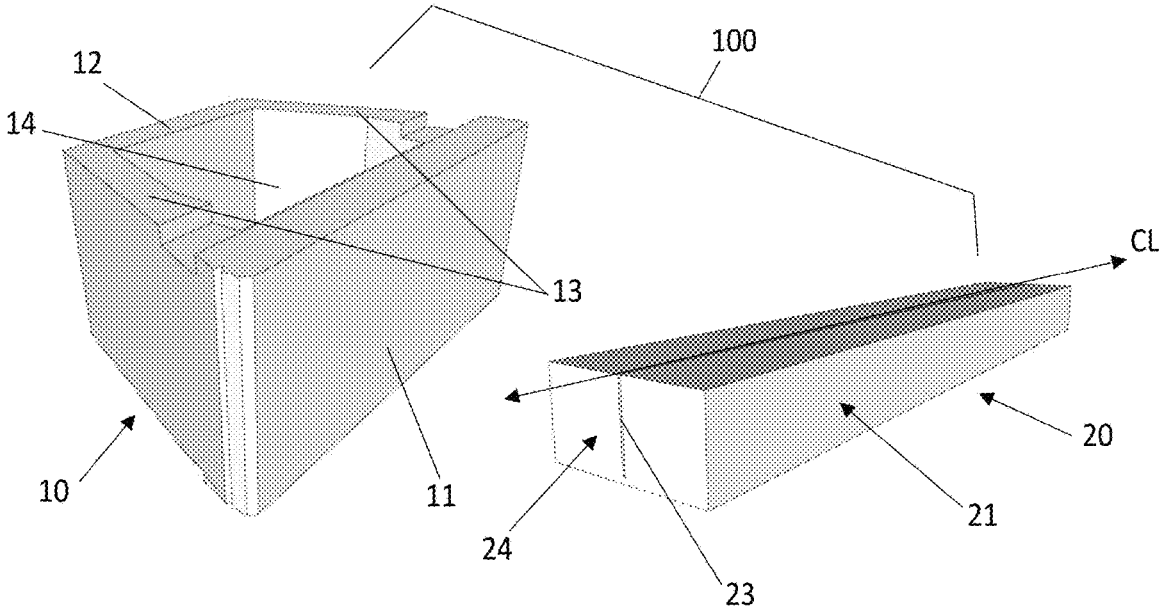
FIG. 1 is a perspective view of a block and a setback bar of a retaining wall block kit according to the present invention.

A retaining wall block kit 100 as shown in FIG. 1 includes a block 10 having a front section 11, a rear section 12 spaced apart from the front section 11, and a pair of laterally spaced apart side sections 13, 13 connecting the front section and the rear section to define a generally trapezoidal through-cavity (core) 14 extending through the block 10 from a top face thereof to a bottom face thereof. The retaining wall block kit 100 further includes an adjustable setback bar 20 having a front surface 21, a rear surface 22, and a break line 23 extending in a longitudinal direction of the setback bar between sides 24, 24 of the setback bar 20, and located along a widthwise centerline CL between the front surface 21 and the rear surface 22.

Figures 2A, 2B, 2C:
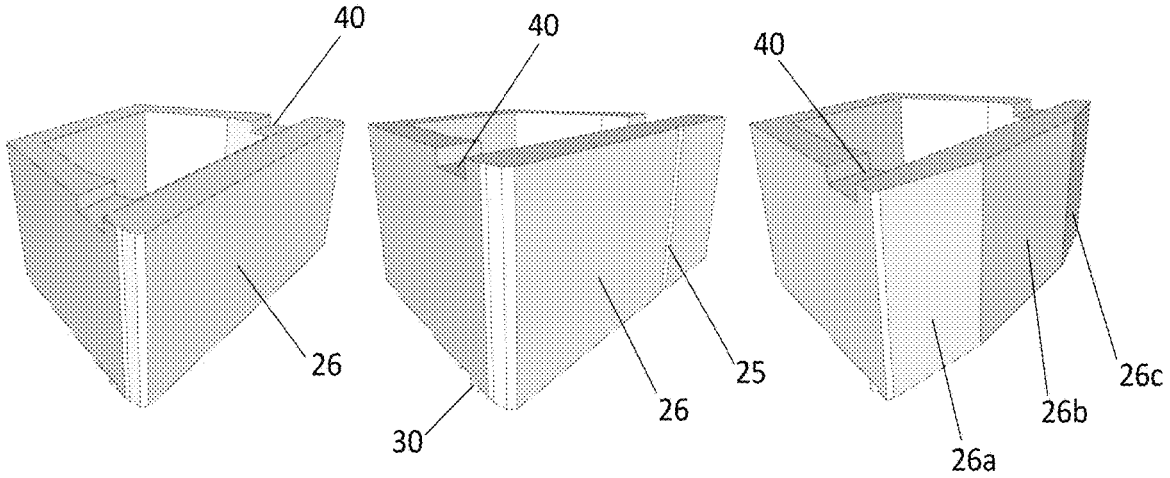
FIGS. 2A-2C are front perspective views of three alternative forms for the block of the present invention.

Each block 10 is made from dry-cast concrete to comply with ASTM-1372, and each block 10 is a one square foot unit. All blocks (units) 10 are made from the same mold, and inserts can be added into the mold to produce a left and/or a right score 25 in a front surface 26. Splitting can create a tri-plane block 10, which is a block 10 with the tri-plane splitface having three non-planar surfaces 26*a*, 26*b*, 26*c*, as shown in FIG. 2C. In addition, the block 10 can have one planar front surface 26 (straight face unit as shown in FIG. 2A), or a scored planar straight front surface 26 with a left or right score 25 to form a splitface as shown in FIG. 2B.

Figure 3A:
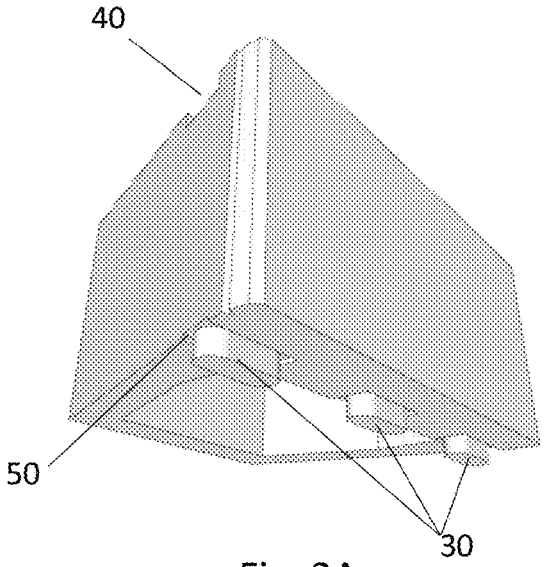
FIGS. 3A and 3B are a bottom perspective view and a bottom view, respectively, of the block of the present invention.
Figure 3B:
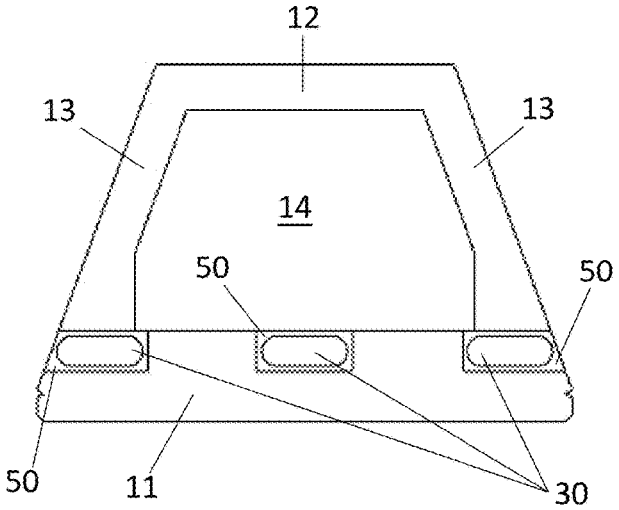

As shown in FIGS. 3A and 3B, the front section 11 of the block 10 has a plurality of alignment knuckles 30 protruding downwardly from a bottom surface of the front section 11 at a location forward of (i.e., closer to the front surface 26 than) the through-cavity 14. As best illustrated in FIG. 3B, the alignment knuckles 30 are laterally spaced apart from one another along a line generally parallel to the front surface 26 of block 10 with the one planar front surface 26, and generally parallel to the front inner surface of the through-cavity 14. Each of the blocks has a 12" overall depth, an 8" (8⅝" with the alignment knuckle 30) height, and an 18" length.

Figure 4A:
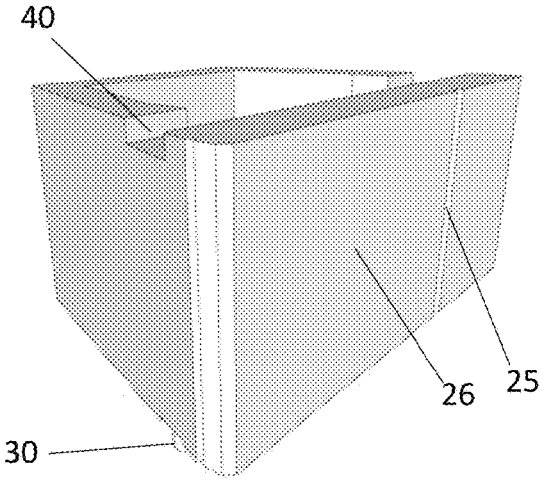
FIGS. 4A and 4B are a top perspective view and a top view, respectively, of the block of the present invention.
Figure 4B:
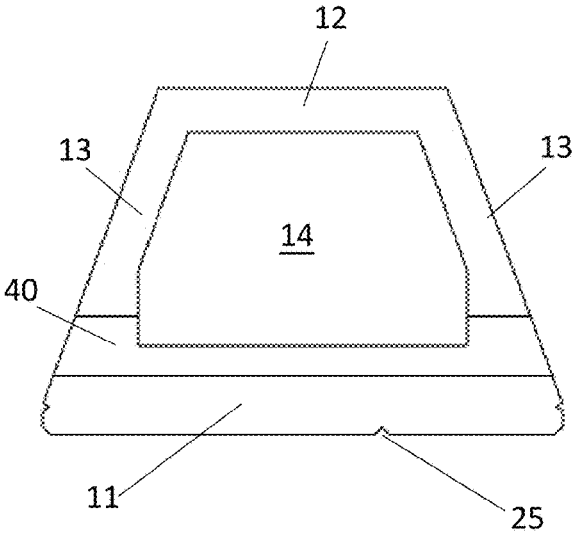

As shown in FIGS. 4A and 4B, the top surface of the front section 11 of the block 10 has a receiver channel 40 extending laterally across the top surface of the front section 11 at a location forward of the through-cavity 14. The receiver channel 40 is located and configured relative to the alignment knuckles 30 so that two blocks 10, 10 can be stacked one atop another with at least one of the alignment knuckles 30 of an upper one of the two blocks engaged within the receiver channel 40 of a lower one of the two blocks. As best illustrated in FIG. 4B, a rear side of the receiver channel 40 can be open to the through-cavity 14. In other words, rather than the receiver channel 40 being a groove formed entirely within the top surface of the front section 11 to have a U-shaped cross-section enclosed on three sides by the front section 11, the receiver channel 40 can have a front surface and bottom surface in the front section 11, with the rear side of the receiver channel 40 being open to the through-cavity 14 to allow easier stacking of blocks 10. In this case, the receiver channel 40 is formed partially within each of the side sections 13, 13, and so a partial rear wall of the receiver channel 40 is formed in the side sections 13, 13. The receiver channel 40 and the alignment knuckles 30 are formed so that the blocks 10 are stackable to form a default setback or batter of, for example, ⅛" for an 8" high block. This default setback applies if the setback bar 20 is not arranged in the receiver channel 40 upon stacking of the blocks 10 to form the retaining wall.

Figure 5:
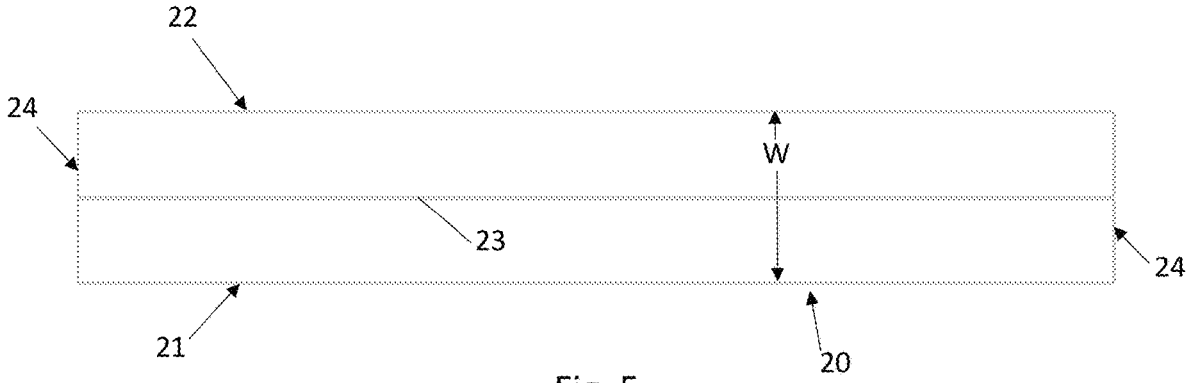
FIG. 5 is a top view of the setback bar of the present invention.

As shown in FIG. 5, the setback bar 20 is, for example, 1" in width W (distance from the front surface 21 to the rear surface 22), and can be split (preferably by hand) along the break line 23 to be used in whole or in part. Therefore, with this configuration, the setback bar 20 is adjustable to allow for an additional ½" or 1" setback per 8" of height. The setback bar 20 can be made of extruded plastic or fiberglass material with an approximately 3000+ PSI compressive strength. The height of the setback bar is not particularly critical, provided that the height is sufficient to ensure enough front surface to abut against the front surface of the receiver channel 40 and enough rear surface against which one or more of the alignment knuckles 30 will abut. The length of the setback bar 20 should be larger than the length of the front surface of the through-cavity 14 to prevent the setback bar 20 from inadvertently falling into the through-cavity 14 during stacking, but should not be longer than the receiver channel 40 to avoid interference with laterally adjacent blocks 10.

The break line 23 of the setback bar 20 can be any perforations, holes, a groove, notches or the like that are linearly-arranged along the widthwise centerline CL located between the front surface 21 and the rear surface 22 of the setback bar 20 so as to allow a relatively clean break along the widthwise centerline CL, as applicable. Thus, the size/depth of the perforations, holes, groove, notches, or the like forming the break line 23 should be sufficient to allow the setback bar 20 to be snapped (split) along the widthwise centerline CL, preferably by hand. For example, as illustrated in FIGS. 1 and 5, the break line 23 can be a groove 23 having a depth extending in a heightwise direction through the setback bar 20 and extending all or nearly all of the length of the setback bar 20 to allow the setback bar 20 to be split preferably by hand. If the setback bar 20 is split, such a groove 23 will form a smooth adjusted rear surface for the setback bar 20 against which the one or more alignment knuckles 30 of an upper block 10 can abut.

By omitting the setback bar 20 entirely from the receiver channel 40 before placing (stacking) the upper block 10, the setback (batter) of the retaining wall will be the default setback, which is ⅛" in the example described above. However, by first splitting the setback bar 20 along the break line 23, an adjusted setback bar having a smaller width (for example, an adjusted width of ½" as in the example noted above) will be produced. By arranging this adjusted setback bar 20 (for example, the front half of the setback bar 20) within the receiver channel 40, the setback (batter) of the retaining wall will be increased, for example, by ½" to a setback of ⅝" for 8" of height in the specific example discussed above. If, however, the setback bar 20 is placed in the receiver channel 40 as a whole without being split, the setback (batter) of the retaining wall will be further increased. Again, referring to the particular example described above in which the default setback is ⅛" and the setback bar is 1" in width when not split, the resulting setback (batter) of the retaining wall will be 1⅛" for 8" of height.

Thus, the removable setback bar provides for easy adjustment of the setback (batter) of the retaining wall, depending on the particular application. After the desired amount of the setback is determined, and the setback bar 20 (in whole or in part) is arranged in the receiver channel 40 or omitted entirely, the upper block 10 is then position so that the one or more of the alignment knuckles 30 of the upper block 10 abut against the rear surface of the setback bar 20 within the receiver channel 40.

As shown in FIGS. 3A and 3B, the number of alignment knuckles 30 protruding downwardly from the bottom surface of the front section can be three alignment knuckles 30 evenly spaced apart and aligned along a straight line on the bottom surface of the front section 11. Furthermore, each of the alignment knuckles 30 generally has an oval shape including curved ends, as well as a straight front side and a straight rear side both of which are generally parallel to the straight planar front surface 26 of the block 10 and to the front surface of the through-cavity 14 (i.e., the rear surface of the front section 11). The straight front and rear sides of the alignment knuckles are also parallel to the front surface of the receiver channel 40, allowing the alignment knuckles to abut the front surface of the receiver channel of a lower block 10 while laying flat against that front surface for proper alignment of the blocks.

One or more of the alignment knuckles 30 protruding downwardly from the bottom surface of the front section 11 of each block 10 can also be removed during assembly of the retaining wall, if desired to provide some flexibility in the shape of the retaining wall. In this regard, although the present invention is certainly not limited to blocks 10 having three evenly-spaced alignment knuckles 30 as described above, such an arrangement provides an opportunity for quick and easy modifications to achieve a desired retaining wall shape. In particular, during assembly of the retaining wall, the middle one of the three evenly-spaced alignment knuckles 30 of an upper block 10 can be removed prior to stacking the upper block 10 atop a lower block 10 to form a retaining wall with a concave radius. Alternatively, the outer two of the three alignment knuckles 30 of the upper block 10 can be removed prior to stacking the upper block 10 atop the lower block 10 to form a retaining wall with a convex radius. When forming a relatively straight segment of a retaining wall (i.e., with no convex or concave radius), all of the alignment knuckles 30 can remain to serve as guides for proper alignment of the blocks 10.

As also shown in FIGS. 3A and 3B, the front section 11 of the block 10 can have a densification groove 50 formed around a base of each of the alignment knuckles 30. The densification groove 50 is a compressed (compacted) area of the front section 11 formed during or after the molding process used to form the blocks 10. The compression of an area of the bottom surface of the front section 11 of each block 10 creates a recess surrounding each of the alignment knuckles 30. This compressed area of the front section 11 of the block 10 forming the densification groove 50 is more dense than other areas of the front section 11 which are not formed as a densification groove 50 surrounding a respective alignment knuckle 30, and also more dense than any other sections of the block 10 (i.e., the rear section 12 and side sections 13, 13). The compressed densification groove 50 at the base of each alignment knuckle 30 therefore improves the strength of each alignment knuckle 30, thereby minimizing the chance of accidental breakage or chipping of the alignment knuckles 30.

Figure 6A:
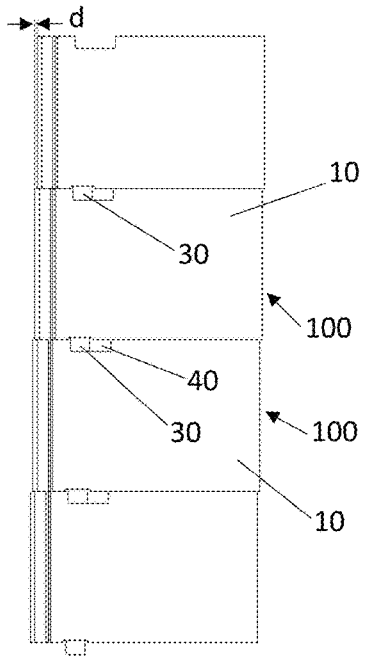
FIGS. 6A-6C are side views of a retaining wall formed with the retaining wall block kit according to the present invention.
Figure 6B:
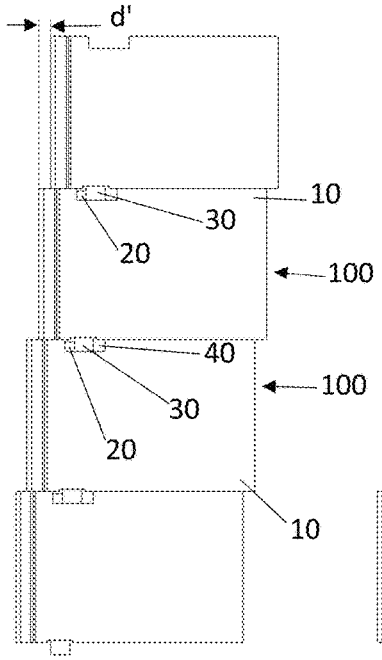
Figure 6C:
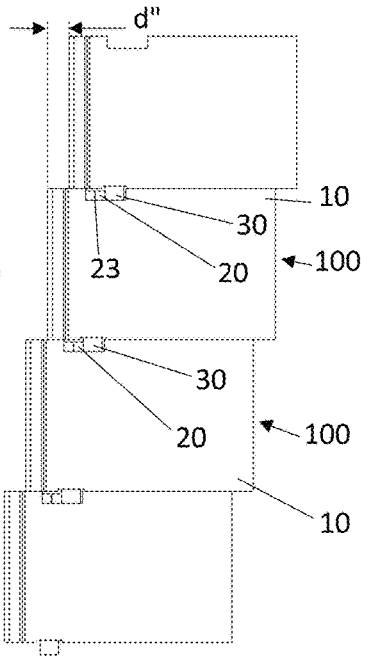

The invention is also directed to a method of assembling a retaining wall using a pair of (first and second) retaining wall block kits 100. Each of the retaining wall block kits 100 is configured as described above including a block 10 and a setback bar 20. First, one of a first setback d (batter), a second setback d' (batter), and a third setback d" (batter) for the retaining wall is chosen based on design criteria for the retaining wall (e.g., the height and location of the retaining wall), as shown in FIGS. 6A-6C. As noted in the example described above, the first (default) setback d can be ⅛", the second setback d' can be ⅝", and the third setback d" can be 1⅛". After choosing the desired setback, the setback bar 20 will be omitted from the receiver channel 40, modified and arranged within the receiver channel 40, or simply arranged within the receiver channel 40 without modification.

In particular, if the first (smallest) setback d is chosen, the setback bar 20 is omitted from (i.e., not inserted within) the receiver channel 40 of the (lower) block 10 of the first retaining wall block kit 100. If the second (intermediate) setback d' is chosen, the setback bar 20 is split along the break line 23 as discussed above, and placed within the receiver channel 40 such that the front surface of the setback bar 20 abuts against a front surface of the receiver channel 40. In this case, the newly exposed surface along the break line 23 formed when the setback bar 20 is split becomes an adjusted rear surface of the setback bar 20. If the third (largest) setback d" is chosen, the setback bar 20 is placed within the receiver channel 40 without adjustment or modification such that the front surface of the setback bar 20 abuts against the front surface of the receiver channel 40.

The (upper) block 10 of the second retaining wall block kit 100 is then stacked atop the lower block 10 so that one or more of the alignment knuckles 30 of the upper block 10 is engaged within the receiver channel 40 of the lower block 10. The stacking is performed so that the one or more of the alignment knuckles 30 of the upper block abuts against either (i) the front surface of the receiver channel 40 if the first (smallest) setback d is chosen (see FIG. 6A), (ii) the adjusted rear surface of the setback bar 20 if the second setback d' is chosen (see FIG. 6B), or (iii) the rear surface of the unadjusted and unmodified setback bar 20 if the third (largest) setback d" is chosen (see FIG. 6C). Thus, as can be clearly seen in FIGS. 6A-6C, the setback bar 20 is adjustable by being modified or omitted altogether to change the distance between a front surface of the alignment knuckles 30 and a front surface of the receiver channel 40. This, in turn, allows the setback of the retaining wall to be easily changed as desired for the particular retaining wall application without the need for using different types and sizes of blocks 10, and while allowing quick and easy stacking of the blocks to assemble the retaining wall.

The through-cavity 14 of the block 10 of each retaining wall block kit can also be filled with crushed aggregate to provide additional interlock and mass to the retaining wall. In addition, geogrid can be applied between the lower and upper blocks 10 when assembling the retaining wall to improve stability of the retaining wall. For example, if the height of the retaining wall will be greater than 3 feet, the retaining wall can be reinforced with geogrid laid between upper and lower blocks 10 without affecting the benefits of the retaining wall block kit 100 including the block 10 and setback bar 20 as described above.

We claim:

1. A retaining wall block kit comprising:

a block having:

a front section;

a rear section spaced apart from the front section; and a pair of laterally spaced apart side sections connecting the front section and the rear section to define a through-cavity extending through the block from a top face thereof to a bottom face thereof; and an adjustable setback bar having a front surface, a rear surface, and a break line extending in a longitudinal direction of the setback bar along a widthwise centerline between the front surface and the rear surface, wherein the front section of the block has a plurality of alignment knuckles protruding downwardly from a bottom surface of the front section at a location forward of the through-cavity, the alignment knuckles being laterally spaced apart from one another, wherein a top surface of the front section of the block has a receiver channel extending laterally across the top surface of the front section at a location forward of the through-cavity, the receiver channel being located and configured relative to the alignment knuckles so that two blocks can be stacked one atop another with at least one of the alignment knuckles of an upper one of the two blocks engaged within the receiver channel of a lower one of the two blocks, and wherein the setback bar is removably located within the receiver channel such that the front surface abuts against a front surface of the receiver channel and to allow the at least one of the alignment knuckles of the upper one of the two blocks to abut against the rear surface of the setback bar, and wherein the setback bar is configured to be split along the break line such that, when the setback bar is split and located within the receiver channel such that the front surface abuts against the front surface of the receiver channel, an exposed surface along the break line becomes an adjusted rear surface to allow the at least one of the alignment knuckles of the upper one of the two blocks to abut against the adjusted rear surface of the setback bar.

2. The retaining wall block kit according to claim 1, wherein the plurality of alignment knuckles protruding downwardly from the bottom surface of the front section is three alignment knuckles aligned along a straight line on the bottom surface.

3. The retaining wall block kit according to claim 1, wherein the front section of the block has a densification groove around a base of each of the alignment knuckles, the densification groove being a compressed area of the front section at which the block is more dense than an area of the front section not formed as the densification groove.

4. The retaining wall block kit according to claim 1, wherein each of the alignment knuckles has an oval shape including a straight front side and a straight rear side parallel to the straight front side.

5. The retaining wall block kit according to claim 1, wherein the setback bar is 1" in width when whole, and ½" in width when split along the break line.

6. The retaining wall block kit according to claim 5, wherein the break line of the setback bar is a groove extending through the setback bar to allow the setback bar to be split.

7. The retaining wall block kit according to claim 1, wherein the break line of the setback bar is a groove extending through the setback bar to allow the setback bar to be split.

8. The retaining wall block kit according to claim 1, wherein the front section has three non-planar front surface sections.

9. The retaining wall block kit according to claim 1, wherein the front section has one planar front surface.

10. The retaining wall block kit according to claim 1, wherein a rear side of the receiver channel is open to the through-cavity.

11. A method of assembling a retaining wall using a first retaining wall block kit and a second retaining wall block kit, each of the first and second retaining wall block kit including a block having a front section, a rear section spaced apart from the front section, and a pair of laterally spaced apart side sections connecting the front section and the rear section to define a through-cavity extending through the block from a top face thereof to a bottom face thereof, each of the first and second retaining wall block kit further including an adjustable setback bar having a front surface, a rear surface, and a break line extending in a longitudinal direction of the setback bar along a widthwise centerline between the front surface and the rear surface, wherein the front section of the block has a plurality of alignment knuckles protruding downwardly from a bottom surface of the front section at a location forward of the through-cavity, the alignment knuckles being laterally spaced apart from one another, wherein a top surface of the front section of the block has a receiver channel extending laterally across the top surface of the front section at a location forward of the through-cavity, the method comprising:

choosing one of a first setback, a second setback, and a third setback for the retaining wall based on design criteria for the retaining wall, the first setback being smaller than the second setback, and the second setback being smaller than the third setback;

adapting and arranging the setback bar of the first retaining wall block kit as follows:

if the first setback is chosen, omitting the setback bar from the receiver channel of the block of the first retaining wall block kit;

if the second setback is chosen, splitting the setback bar along the break line and placing the setback bar within the receiver channel such that a front surface of the setback bar abuts against a front surface of the receiver channel, an exposed surface along the break line becoming an adjusted rear surface of the setback bar; and if the third setback is chosen, placing the setback bar within the receiver channel such that a front surface of the setback bar abuts against a front surface of the receiver channel; and stacking the block of the second retaining wall block kit atop the block of the first retaining wall block kit so that at least one of the alignment knuckles of the block of the second retaining wall block kit is engaged within the receiver channel of the block of the first retaining wall block kit, and such that the at least one of the alignment knuckles of the block of the second retaining wall block kit abuts against one of (i) the front surface of the receiver channel if the first setback is chosen, (ii) the adjusted rear surface of the setback bar if the second setback is chosen, or (iii) the rear surface of the setback bar if the third setback is chosen.

12. The method according to claim 11, wherein the plurality of alignment knuckles protruding downwardly from the bottom surface of the front section is three alignment knuckles aligned along a straight line on the bottom surface.

13. The method according to claim 12, further comprising removing the inner one of the three alignment knuckles of the block of the second retaining wall block kit prior to stacking the block of the second retaining wall block kit atop the block of the first retaining wall block kit to form a retaining wall with a concave radius.

14. The method according to claim 12, further comprising removing the outer two of the three alignment knuckles of the block of the second retaining wall block kit prior to stacking the block of the second retaining wall block kit atop the block of the first retaining wall block kit to form a retaining wall with a convex radius.

15. The method according to claim 11, further comprising filling the through-cavity of the block of each of the first and second retaining wall block kit with crushed aggregate.

16. The method according to claim 11, further comprising applying geogrid between the block of the first retaining wall block kit and the block of the second retaining wall block kit.

17. The method according to claim 11, wherein the break line of the setback bar is a groove extending through the setback bar to allow for the splitting of the setback bar if the ⅝" setback is chosen.

18. The method according to claim 11, wherein the first setback is a ⅛" setback, the second setback is a ⅝" setback, and the third setback is a 1⅛" setback.

* * * * *